US006431937B1

(12) United States Patent
Lau et al.

(10) Patent No.: US 6,431,937 B1
(45) Date of Patent: Aug. 13, 2002

(54) TOY SYSTEM

(75) Inventors: Jack Lau; Chi Wah Lo; Chun Yeung Keung, all of Hong Kong (HK)

(73) Assignee: Infinite Dream Machine Limited (HK)

( * ) Notice: Subject to any disclaimer, the term of this patent is extended or adjusted under 35 U.S.C. 154(b) by 0 days.

(21) Appl. No.: 09/618,785

(22) Filed: Jul. 18, 2000

(51) Int. Cl.[7] ..... A63H 30/00

(52) U.S. Cl. ..... 446/175; 446/297; 446/397; 446/219

(58) Field of Search ..... 446/175, 219, 446/296, 297, 298, 404, 408, 454, 456, 484, 302, 303; 340/384.1, 384.3, 815.49, 815.55, 815.6

(56) References Cited

U.S. PATENT DOCUMENTS 4,865,575 A * 9/1989 Rosenthal ..... 446/175
4,964,837 A * 10/1990 Collier ..... 446/409
4,995,294 A * 2/1991 Kashio et al. ..... 84/738
5,058,480 A * 10/1991 Suzuki et al. ..... 84/600
5,452,901 A * 9/1995 Nakada et al. ..... 273/310
5,648,753 A * 7/1997 Martin ..... 340/324.1
6,150,947 A * 11/2000 Shima ..... 340/692
6,297,438 B1 * 10/2001 Por Paul ..... 84/600

* cited by examiner

*Primary Examiner*—Jessica J. Harrison
*Assistant Examiner*—Alex F. R. P. Rada, II
(74) *Attorney, Agent, or Firm*—Burns, Doane, Swecker & Mathis, L.L.P.

(57) ABSTRACT

A toy is disclosed as including a baton-like signal transmitter (10) and a doll (44) which includes an infrared signal receiver (46) for receiving infrared signals from the signal transmitter (10), in which the doll (44) produces sound, e.g. songs, in response to signals received from the signal transmitter (10), and the signals are transmitted by the signal transmitter (10) upon movement of the signal transmitter (10).

22 Claims, 8 Drawing Sheets

| | | | | | | | |
|---|---|---|---|---|---|---|---|
| ST | B1 | B2 | B3 | B4 | B5 | P | SP |

FIG. 7A

| | | | | | | | | | | | | |
|---|---|---|---|---|---|---|---|---|---|---|---|---|
| A1 | S | A2 | S | A3 | S | A1 | S | A2 | S | A3 | S | AD |

FIG. 7B

TOY SYSTEM

This invention relates to a toy system and, in particular, a toy system in which one or more dolls produce musical notes in response to signals received from a baton-like signal transmitting device.

BACKGROUND OF THE INVENTION

There are in existence a large variety of music-producing toys or entertainment apparatus. In most such toys or entertainment apparatus, a user can only turn on or turn off the toy, or can at best choose the music which he/she wants to hear. It is, however, not possible to vary the speed at which the music is played. Most people, adults and children alike, are envy of the position of a conductor, who can, with a baton, conduct an orchestra with a large number of players of musical instruments.

It is thus an object of the present invention to provide a toy system in which the aforesaid shortcoming is mitigated, or at least to provide a useful alternative to the public.

SUMMARY OF THE INVENTION

According to a first aspect of the present invention, there is provided a toy comprising a signal transmitter and at least one doll including a signal receiver adapted to receive signals from said signal transmitter, wherein said at least one doll is adapted to produce sound in response to signals received from said signal transmitter, wherein said signals are adapted to be transmitted by said signal transmitter upon movement of said signal transmitter.

According to a second aspect of the present invention, there is provided a toy apparatus including at least one infrared signal transmitting member adapted to transmit infrared signals in response to movement of said apparatus.

According to a third aspect of the present invention, there is provided a toy apparatus including a signal receiver adapted to receive signals from an outside source and to produce sound in response thereto, wherein said sound is produced at a speed adapted to vary in response to said received signals.

BRIEF DESCRIPTION OF THE DRAWINGS

A preferred embodiment of the present invention will now be described, by way of example only, and with reference to the accompanying drawings, in which:

FIG. 7A shows the pattern of a data packet transmitted by the signal transmitter shown in FIG. 1;

FIG. 7B shows the pattern of data sequence transmitted by the signal transmitter shown in FIG. 1.

DETAILED DESCRIPTION OF THE PREFERRED EMBODIMENTS

Figure 1:
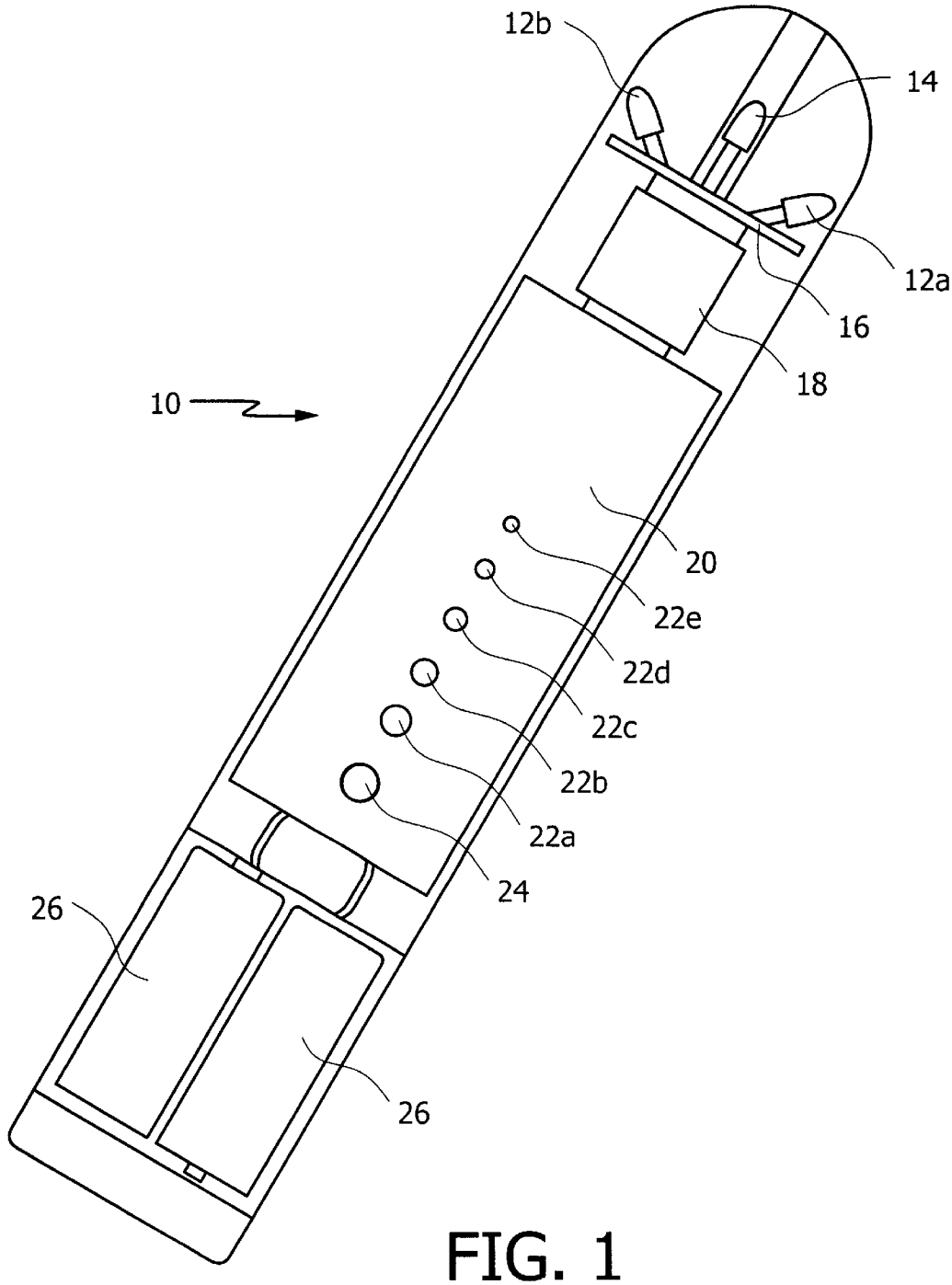
FIG. 1 is a perspective view of a signal transmitter in the shape of a baton according to the present invention.

A signal transmitter according to the present invention is shown in FIG. 1 in the shape of a baton and generally designated as 10. The transmitter 10 includes at one end thereof an array of light emitting diodes (LEDs) 12*a*, 12*b*, 12*c*, 14, to be shown more clearly in FIG. 2. The LEDs 12*a*, 12*b*, 12*c*, 14 are designed to transmit signals within the infrared range. The LEDs 12*a*, 12*b*, 12*c*, 14 are connected to a first printed circuit board (PCB) 16, which also supports the LEDs 12*a*, 12*b*, 12*c*, 14. Below the PCB 16 is a mechanical motion sensing device 18, further details of which will be discussed below. Also provided within the transmitter 10 is a second PCB 20 connected with five lights 22*a*, 22*b*, 22*c*, 22*d*,22*e* and a button 24. The various electronic and electrical components in the transmitter 10 is powered by two batteries 26 housed within the transmitter 10.

Figure 2:
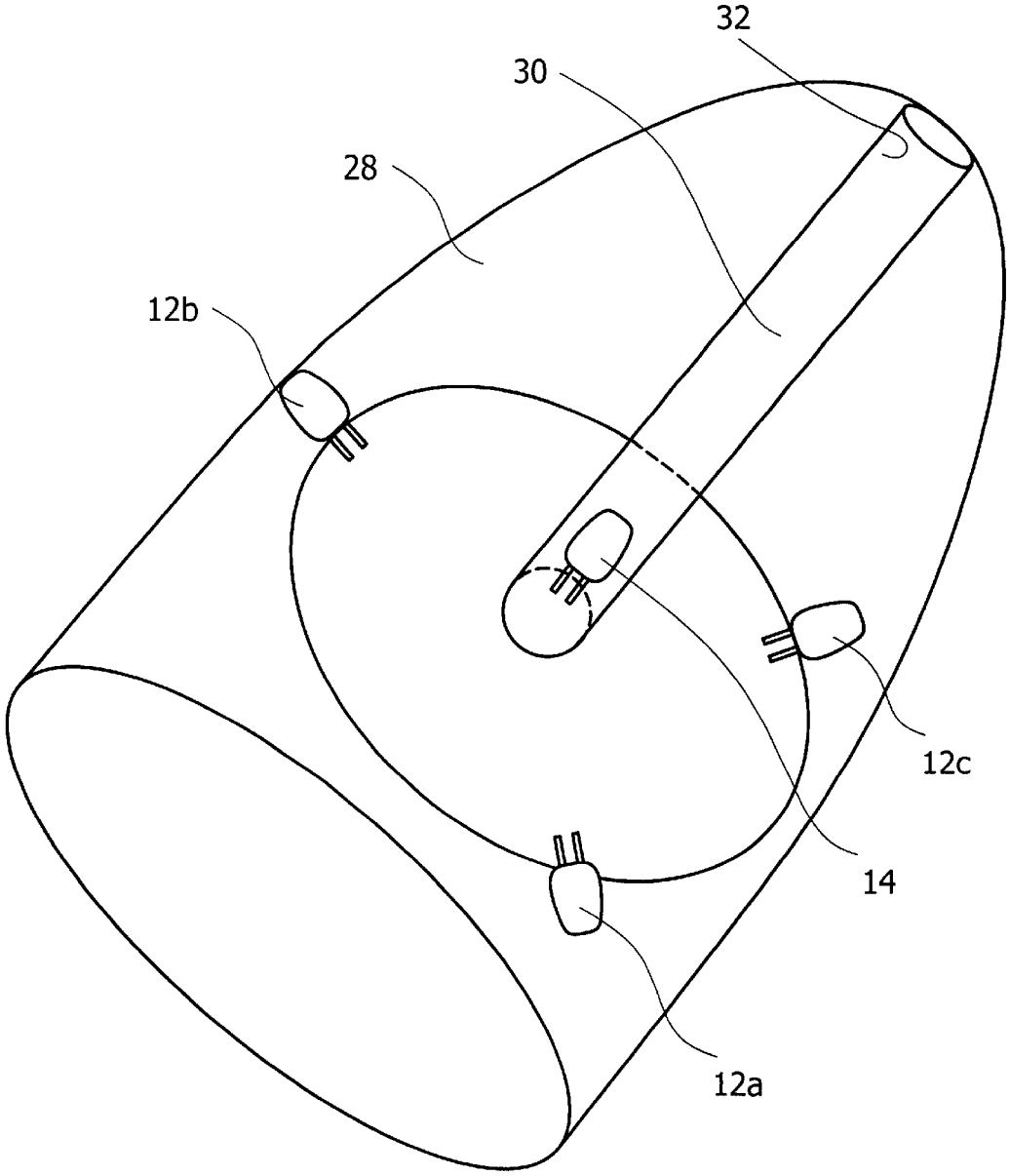
FIG. 2 is an enlarged perspective partial view of an end of the signal transmitter shown in FIG. 1.

As can be seen more clearly in FIG. 2, the transmitter 10 includes three LEDs 12*a*, 12*b*, 12*c* and an LED 14. The arrangement of the three LEDs 12*a*, 12*b*, 12*c* allows signals emitted by the LEDs 12 to be transmitted over a wide angle, and thus received by the intended signal receiver(s) (to be discussed below) even if the receiver(s) are not directly facing the transmitter 10. The LED 14 is a directional LED. When a user points the transmitter 10 at a specific signal receiver, he/she may signal the receive r to lower its volume or change the tempo/speed at which sound is produced. The LEDs 12*a*, 12*b*, 12*c*, 14 transmit signals within the infrared range. To enhance the transmission efficiency, the LEDs 12*a*, 12*b*, 12*c*, 14 are housed within a translucent red capsule 28. The LED 14 is positioned at the bottom of a cylindrical channel 30, with an interior smooth, metallic and light-reflective interior surface 32, which ensures the directionality of the light emitted by the LED 14.

Figure 3:
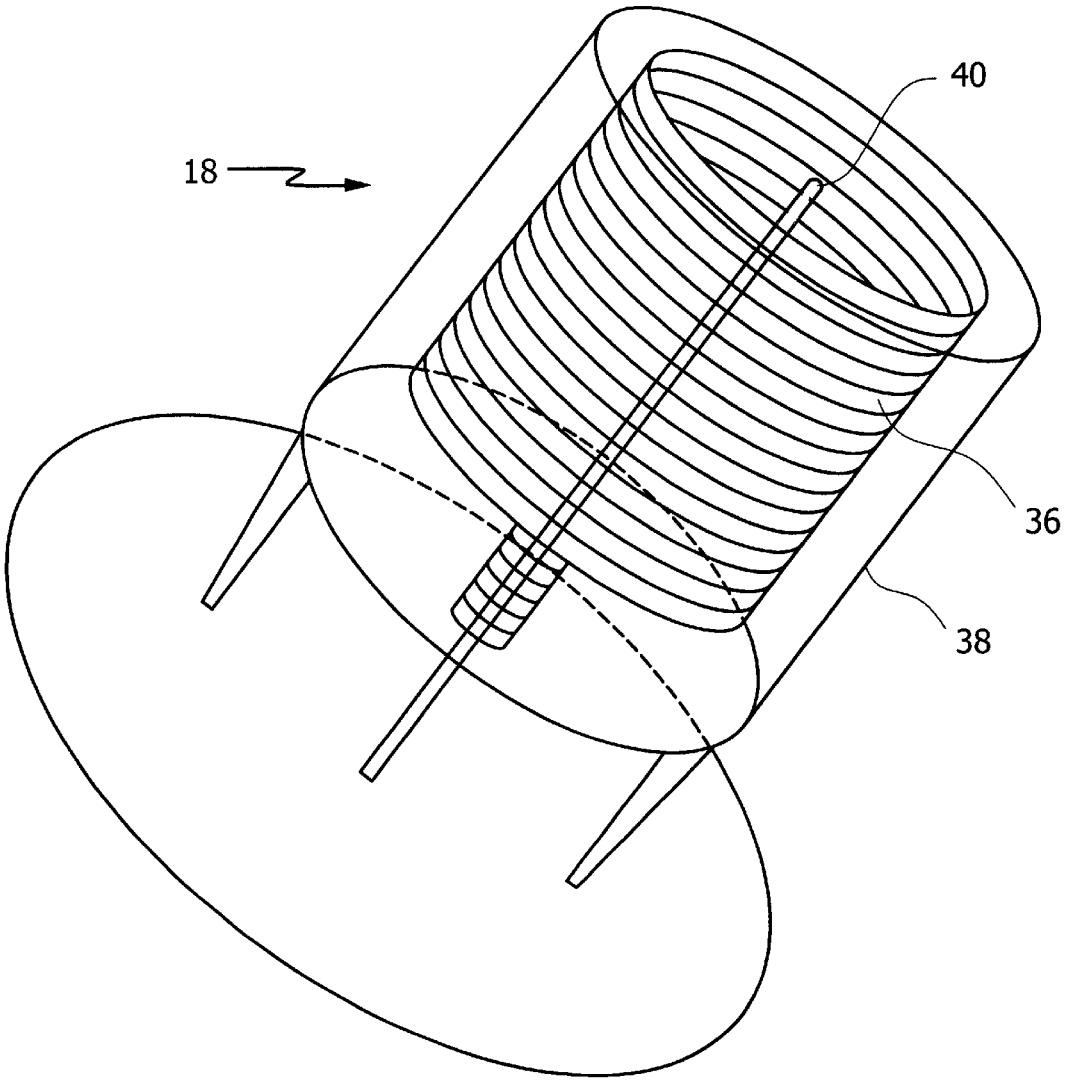
FIG. 3 is an enlarged perspective view of a motion sensor in the signal transmitter shown in FIG. 1.

The motion of the transmitter 10 is detected by the mechanical motion sensing device 18, shown more clearly in FIG. 3. The motion sensing device 18 includes a metallic spring coil 36 which may vibrate to contact an outer circular metallic plate 38 and an inner metallic needle 40. The frequency at which the spring coil 36 comes into contact and out of contact with the outer circular metallic plate 38 and the inner metallic needle 40 indicates the frequency of vibration of the spring coil 36. This information relating to the frequency of vibration of the spring coil 36 is passed on to the electronic circuitry of the transmitter 10, to be discussed below. The LED 14 is responsible for providing directional information to a specific receiver while the LEDs 12*a*, 12*b*, 12*c* convey to the receiver(s) information relating to the speed at which the musical notes are to be produced and other relevant commands.

Referring back to FIG. 1, the PCB 20 contains such electronic components as a central processing unit (CPU) and memory, to be further discussed below. The button 24 may be actioned to select a song from a repertoire of songs. In the transmitter 10 as shown, five songs are provided and five lights 22*a* to 22*e* are provided, each for indicating a respective song. When a particular song is selected, the corresponding light 22*a*, 22*b*, 22*c*, 22*d* or 22*e* will light up. The lights 22*a* to 22*e* may be LEDs. A liquid crystal display (LCD) may be used instead. There is no practical limit to the number of songs that can be stored in the memory in the transmitter 10, as each song is only represented by a handful of musical notes, which occupy only very little memory.

Figure 4:
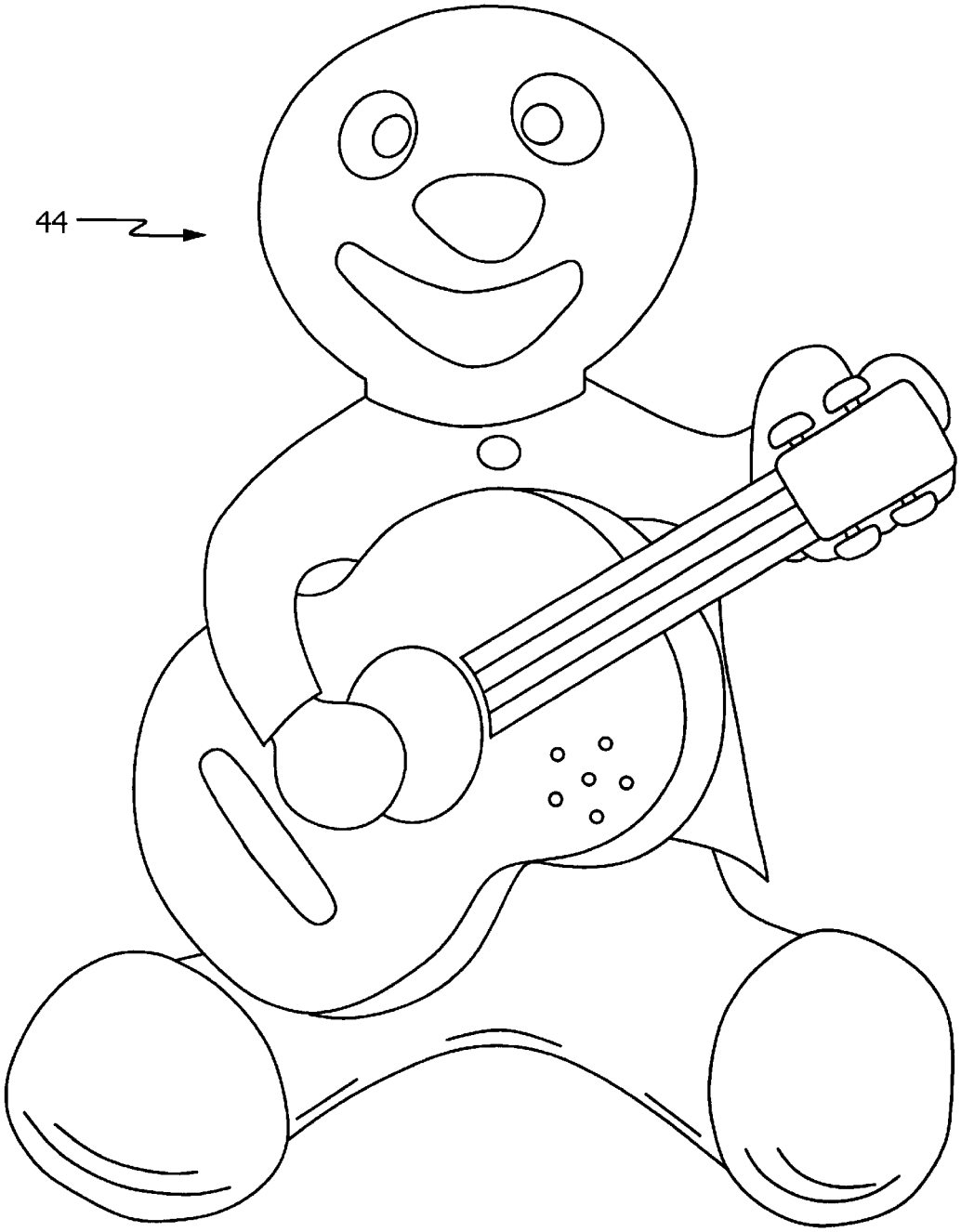
FIG. 4 is a front view of a doll according to the present invention.
Figure 5:
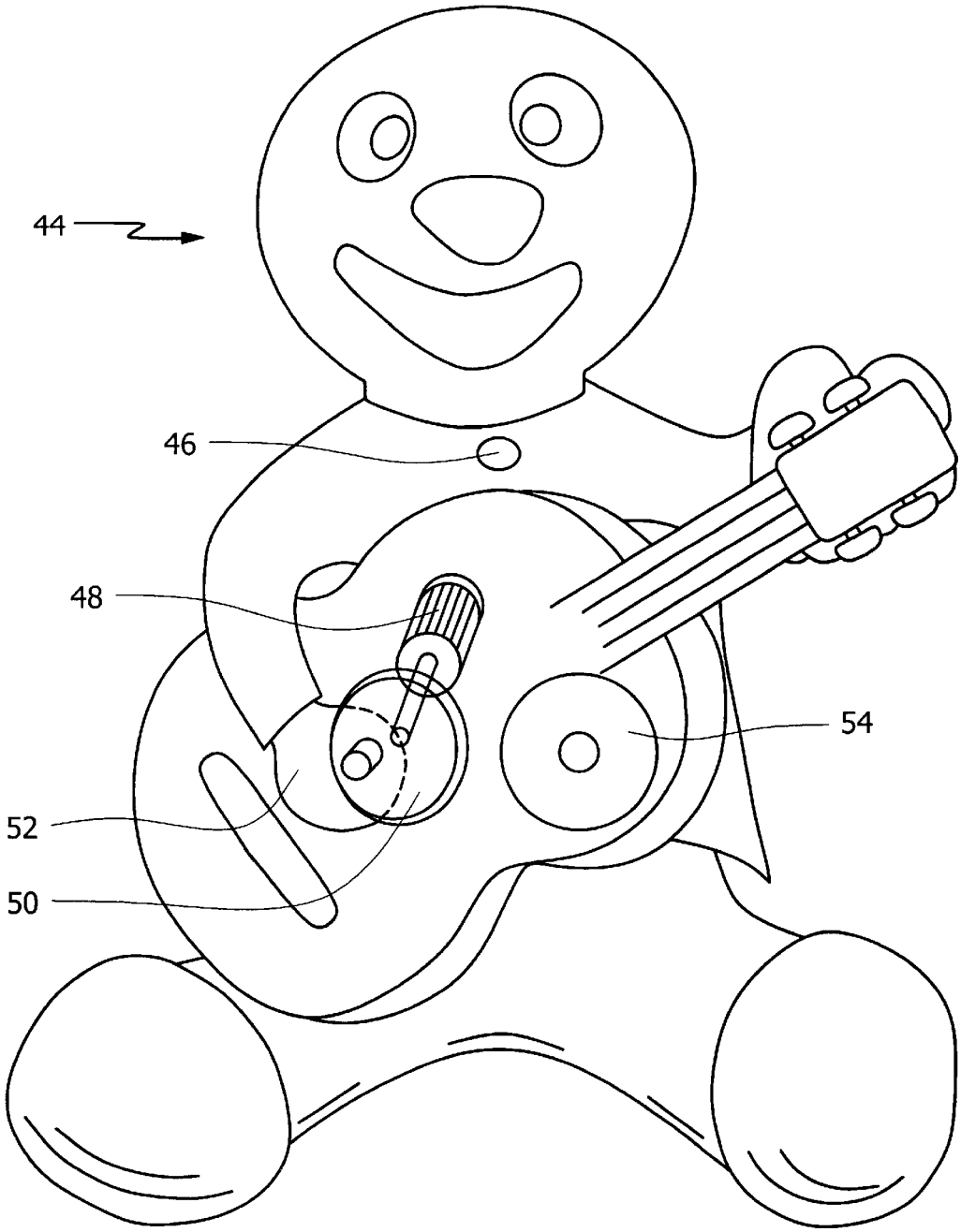
FIG. 5 is a further front view of the doll shown in FIG. 4 with some parts removed.

The toy system according to the present invention also includes at least one doll in the form of an artist playing a musical instrument, although more than one dolls may be included. FIGS. 4 and 5 show a stuffed doll 44 in the form a guitar player. The present invention may include dolls 44 in the form of players of other musical instruments, e.g. flutes, violins, etc. The doll 44 includes an infrared signal receiver 46 for receiving infrared signals transmitted by the LEDs 12*a*, 12*b*, 12*c*, 14 of the transmitter 10. A motor 48 may drive a spindle wheel 50 connected to a hand 52 of the doll 44, to simulate the action of playing guitar. A speaker 54 is provided for outputting sound.

Figure 6:
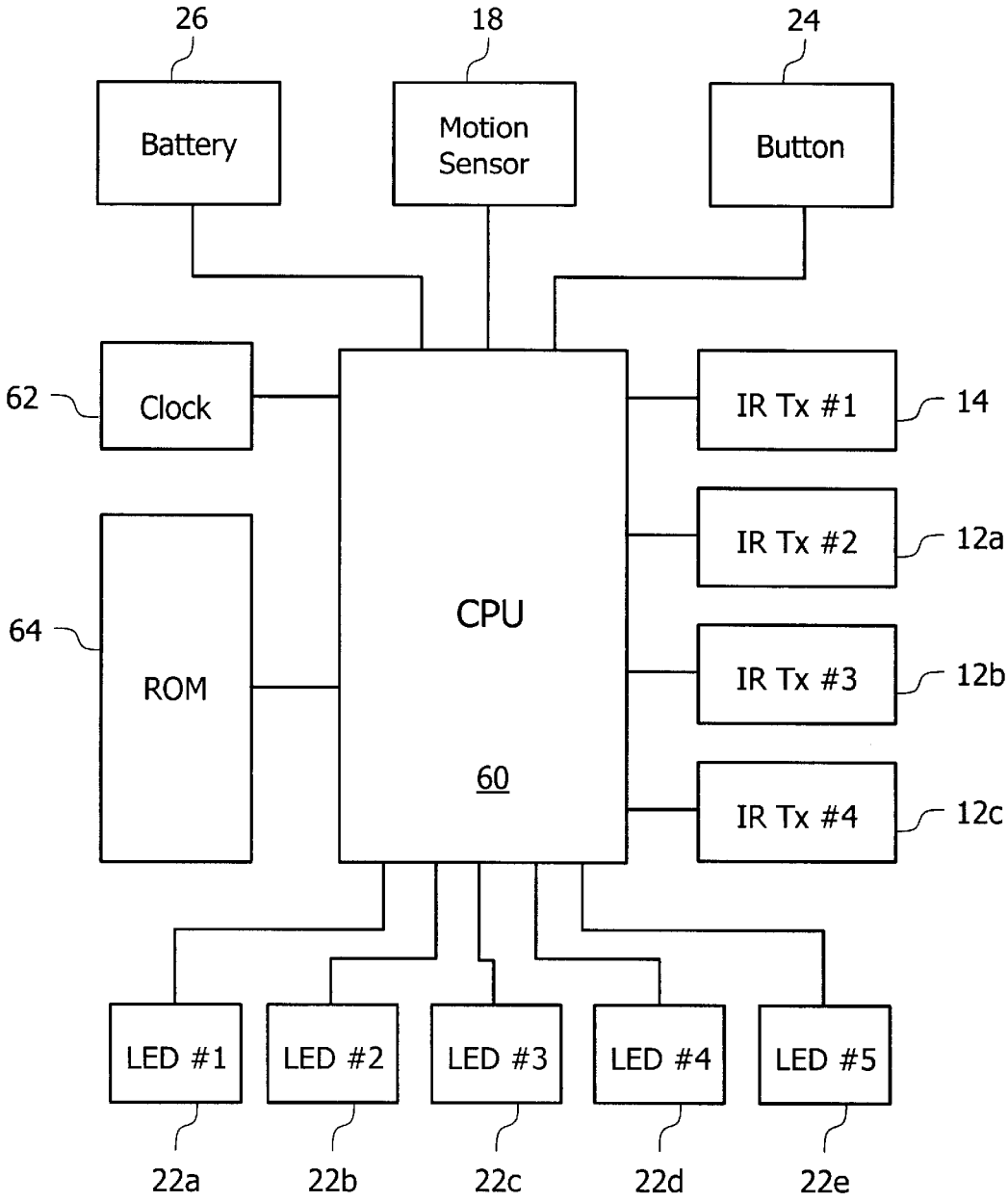
FIG. 6 is a block diagram of a circuitry in the signal transmitter shown in FIG. 1.

FIG. 6 shows a block diagram of the circuitry in the signal transmitter 10, which is powered by one or more batteries 26. Included in the circuitry is a central processing unit (CPU) 60. An appropriate CPU may be a microcontroller traded by Sunplus Technology Co., Ltd., of Taiwan, under Model No. SPMC01A. The motion sensing device 18 passes on at least two types of signals to the CPU 60 for interpretation and further action. The first type of signals indicates the speed of movement of the signal transmitter 10. The second type of signals indicates the specific on-off signal to any individual doll 44. Contact of the spring coil 36 with the outer circular metallic plate 38 and the inner metallic needle 40 will generate digital signals to be passed to the CPU 60 for interpretation. The frequency of such contacts can indicate the speed of the swinging of the signal transmitter 10. On the other hand, the on-off signal is indicated by the sudden stopping and moving of the motion sensing device 18. In other words, the on-off signal is indicated by the acceleration and deceleration of the transmitter 10. In other words, the motion sensing device 18 transmits information relating to the speed and acceleration of the transmitter 10 to the CPU 60. The CPU 60 then processes such signals and transmit them to the dolls 44 via the LEDs 12*a*, 12*b*, 12*c*, 14. An internal clock 62 provides the synchronization signal to the CPU 60, and a read-only-memory (ROM) 64 stores the program code of the processor and the musical notes.

The beat of each note is determined by the speed of the swing of the transmitter 10 by the user. When the transmitter 10 is swung very slowly, the note will be dragged out to reflect the speed. When the transmitter 10 is swung quickly, the note will be the shortest made possible by a pre-defined value. In case a quick swing follows a slow swing, the note will be abruptly changed into a quick tempo with out delay to reflect this change in speed of movement of the transmitter 10.

Another type of signal that has to be interpreted by the CPU 60 is that relating to the selection of music. As mentioned above, the button 24 may be actioned to select one of a plurality of songs whose notes are stored in the ROM 64. In this example, both the program code and the musical notes are stored in a single ROM 64. It is also possible that the two are separately stored. The advantage of separating the program code and the musical notes is that in case more songs are added to the repertoire, only the memory relating to the musical notes need be replaced. Such a replacement may, for example, be accomplished by a change of cartridge.

FIGS. 7A and 7B show the format of the program code used in this example. The data packet is shown in FIG. 7A. A frame of data includes a start bit (ST) and a stop bit (SP). Each frame consists of five data bits, B1, B2, B3, B4 and B5, which collectively represent thirty-one musical notes with an extra bit reserved for on-off. A parity bit P is inserted near the end of the frame.

The data packet is then transmitted through a definite data sequence shown in FIG. 7B. Each of the data packets is consecutively transmitted through the three LEDs 12*a*, 12*b*, 12*c* one by one. In this example, a data packet A1 is transmitted by the LED 12*a*. A silence packet S is inserted during which no data packet is transmitted. The same data pack et (now called"A2") is then transmitted by the LED 12*b*. A silence packet S then follows. The same data packet (now called "A3") is then transmitted by the LED 12*c*, followed again by a silene packet S. The above partial sequence is then repeated again. Such an arrangement ensures that the data packet is received by the receivers 46 of the respective doll 44. Regardless of the direction of the receiver 46 of the respective doll 44 relative to the signal transmitter 10, one of the LEDs 12*a*, 12*b*, 12*c* guarantees line of sight connection. The final on-off signal packet AD is placed at the end of the data sequence, and to be transmitted by the LED 14. There is no need to repeat this on-off packet since the transmitter 10 must be pointing at the specific doll 44 when transmitting this signal.

It can be seen that, in this example, for error correction, a redundancy coding method is used. The LEDs 12*a*, 12*b*, 12*c* transmit the same signals six times. The receivers 46 will thus, at most, receive six data signals. In theory, all six signals should be the same, and the required action is clear. However, in case there is any difference in the signals received, which may be caused by a noisy environment, a level of confidence method is used, namely the most frequently occurred signal pattern (among the six signals) will be treated as the correct signal. If, however, all the six signals are different, the transmission is considered a failure and no action will be taken by the doll 44.

Figure 8:
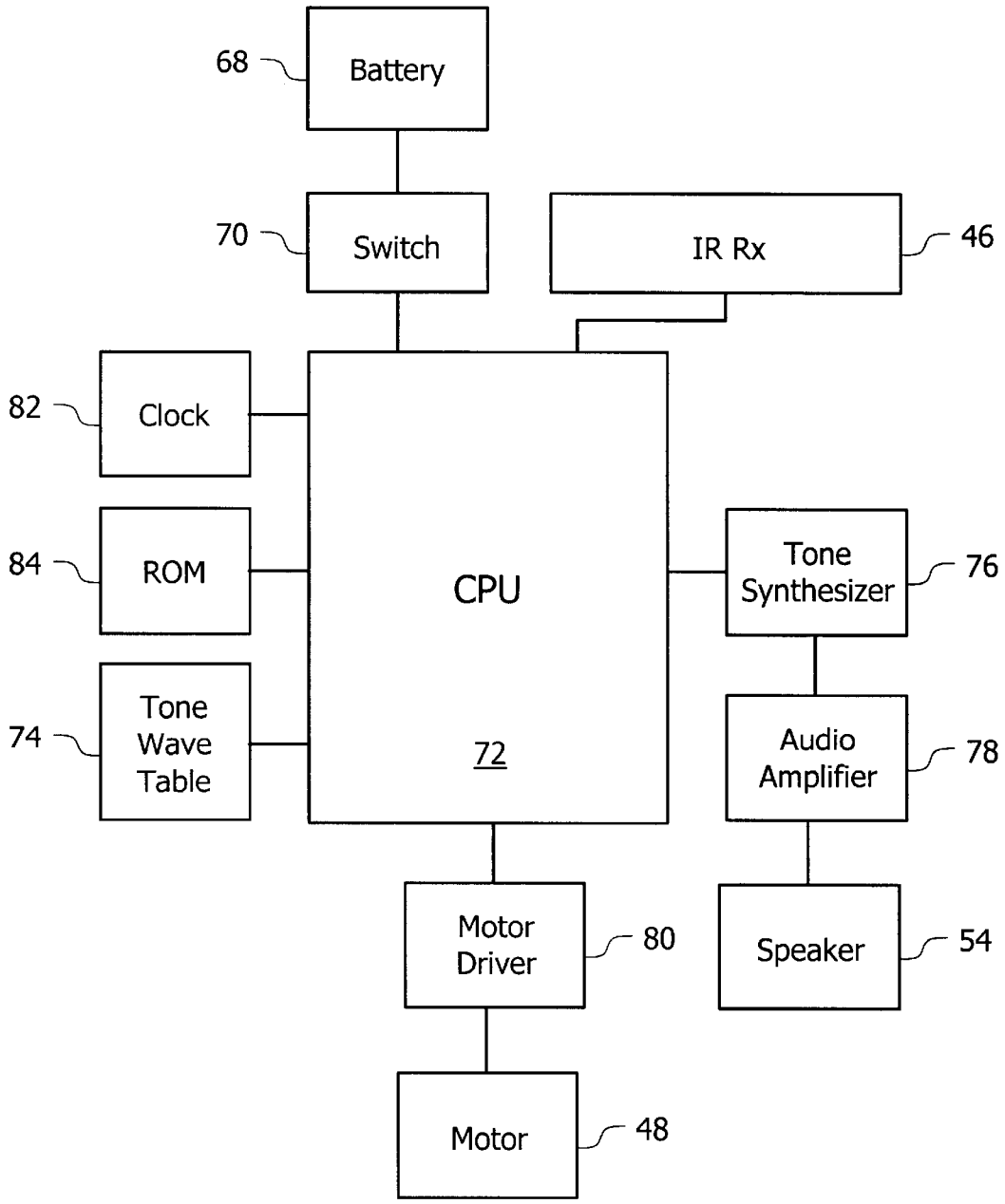
FIG. 8 is a block diagram of a circuitry in the doll shown in FIG. 4.

Part of the command from the directional LED 14 of the transmitter 10 is to turn the doll 44 on or off. The rest of the command from the transmitter 10 includes the speed at which the song is to be played, and the specific song to be played. As can be seen in FIG. 8, the doll 44 is powered by one or more batteries 68, and may also be switched on or off by a mechanical switch 70, which may be at the back of the doll 44. Signals received by the infrared receiver 46 is passed to a central processing unit (CPU) 72 for further action. An appropriate CPU may be the microcontroller traded by Sunplus Technology Co., Ltd., of Taiwan, under Model No. SPMC01A, mentioned above. The fundamental tone of the musical instrument is stored in a tone wave table memory 74. Upon request, the content in the tone wave table memory 74 is passed to a tone synthesizer 76, which in turns activates an audio amplifier 78 to output sound through the speaker 54. In this example, no separate digital to analogue converter is shown, although such is necessary if not provided as part of the audio amplifier circuit 78. It should be noted that each doll 44 only contains a tone synthesizer 76 responsible for synthesizing the sound of one musical instrument only, e.g. flute, guitar, piano, etc.

Commands relating to the speed of movement of the signal transmitter 10 are also passed to a motor driver 80, which in turn drives the motor 48 to control the speed of movement of the hand 56 of the doll 44. An internal clock 82 provides the timing information to the CPU 72, while a read only memory (ROM) 84 stores the program code for the CPU 72.

It should be understood that the above only describes an example whereby the present invention may be worked, and for illustration purposes only. Various modifications may be made to the above example without departing from the spirit of the invention. For example, any sound and even speech may be produced through a change in the tone wave table and the tone synthesizer.

What is claimed is:

1. A toy comprising a signal transmitter that includes a plurality of signal transmitting members and at least one doll including a signal receiver adapted to receive signals from said signal transmitter, wherein said doll is adapted to produce sound in response to signals received from said signal transmitter, and wherein said signal transmitting members are adapted to transmit said signals in response to movement of said signal transmitter.

2. A toy according to claim 1 wherein said signal transmitting member comprises an infrared transmitter.

3. A toy according to claim 2 wherein said signal transmitter includes a non-opaque shield allowing signals emitted from at least one said signal transmitting member to pass through.

4. A toy according to claim 3 wherein said shield is substantially red in colour.

5. A toy according to claim 1 wherein said signal transmitter includes a channel member adapted to guide the direction of transmission of signals transmitted by at least one said signal transmitting member.

6. A toy according to claim 5 wherein said channel member includes a light-reflective surface.

7. A toy according to claim 5, wherein said signal transmitting member is adapted to transmit signals to activate or deactivate said doll.

8. A toy comprising a signal transmitter and at least one doll including a signal receiver adapted to receive signals from said signal transmitter and a music synthesizer adapted to synthesize and produce sound similar to that of a musical instrument via a speaker, wherein said doll is adapted to produce said sound in response to signals received from said signal transmitter, and wherein said signals are adapted to be transmitted by said signal transmitter upon movement of said signal transmitter.

9. A toy according to claim 8 wherein said speaker of said doll produces said sound at a speed adapted to vary in response to at least one of the speed of movement, acceleration or deceleration of said signal transmitter.

10. A toy comprising a signal transmitter and at least one doll including a signal receiver adapted to receive signals from said signal transmitter and a limb member movable at a speed adapted to vary in response to signals received from said signal transmitter, wherein said doll is adapted to produce sound in response to signals received from said signal transmitter, and wherein said signals are adapted to be transmitted by said signal transmitter upon movement of said signal transmitter.

11. A toy apparatus including at least one infrared signal transmitting member adapted to transmit infrared signals in response to movement of said apparatus, and further including a non-opaque shield allowing signals emitted from said signal transmitting member to pass through.

12. An apparatus according to claim 11 wherein said shield is substantially red in colour.

13. A toy apparatus including at least one infrared signal transmitting member adapted to transmit infrared signals in response to movement of said apparatus, and further including a channel member adapted to guide the direction of transmission of signals transmitted by said signal transmitting member.

14. An apparatus according to claim 13 wherein said channel member includes a light-reflective surface.

15. A toy apparatus including a plurality of infrared signal transmitting members arranged substantially on a same plane, and adapted to transmit infrared signals in response to movement of said apparatus.

16. A toy apparatus including at least one infrared signal transmitting member adapted to transmit directional signals in response to movement of said apparatus.

17. A toy apparatus including a signal receiver adapted to receive signals from an outside source and to produce sound in response thereto, wherein said sound is produced at a speed adapted to varying response to said received signals.

18. An apparatus according to claim 17 wherein said signals are infrared signals.

19. An apparatus according to claim 17 further including at least a music synthesizer adapted to synthesize and produce sound similar to that of a musical instrument via a speaker.

20. An apparatus according to claim 17 further including at least a limb member movable at a speed adapted to vary in response to said received signals.

21. An apparatus according to claim 17 in the form of a doll.

22. An apparatus according to claim 21 wherein said doll is in the form of a player of a musical instrument.

* * * * *